US005086673A

United States Patent [19]

Korty

[11] Patent Number: 5,086,673

[45] Date of Patent: Feb. 11, 1992

[54] RATCHET WRENCH WITH POSITIVE LOCKING CAPABILITY

[76] Inventor: David Korty, R.D. 1, Forest City, Pa. 18421

[21] Appl. No.: 688,812

[22] Filed: Apr. 22, 1991

[51] Int. Cl.[5] ..... B25B 13/00

[52] U.S. Cl. ..... 81/59.1; 81/63.1

[58] Field of Search ..... 81/59.1, 60, 63.1; 192/44, 45

[56] References Cited

U.S. PATENT DOCUMENTS

| | | | |
|---|---|---|---|
| 1,904,621 | 4/1933 | Kounovsky | 81/59.1 |
| 2,139,650 | 12/1938 | Anderson et al. | 81/59.1 |
| 2,469,572 | 5/1949 | Pratt | 81/59.1 X |
| 3,621,739 | 11/1971 | Seablom | 81/63.1 X |
| 3,823,625 | 7/1974 | Myers | 81/59.1 |
| 4,669,339 | 6/1987 | Cartwright | 81/63.1 X |

*Primary Examiner*—D. S. Meislin

*Attorney, Agent, or Firm*—Douglas M. Clarkson

[57] ABSTRACT

The disclosure describes a ratchet type of tool drive that has three partitions extending from the walls of a cavity to define channels with a spindle. The walls are thinner at a midpoint of each channel and are thicker adjacent each partition by a limited amount, such as 30 thousandths of an inch. A roller is located within each of the channels with a coil spring on each side. A retainer cover has extensions between each partition and one end of each coil spring, so that turning the cover one way or the other, applies a biasing pressure on each roller to urge the rollers in a desired direction. The structure described has fewer parts, is thinner in configuration and the rollers move in a slight rolling movement to be pinched between the narrowing walls of each channel, to achieve a positive locking and non-slipping action.

10 Claims, 1 Drawing Sheet

RATCHET WRENCH WITH POSITIVE LOCKING CAPABILITY

BACKGROUND OF THE INVENTION

1. Field of the Invention

The present invention, generally, relates to tool drive devices known as ratchet type wrenches and, more particularly, to a new and improved structural arrangement for a reversible ratchet type wrench.

The industry has experienced many sincere efforts to develop ratchet type wrenches that are both reversible in the direction of the drive action and that will maintain a preset position once it is selected for such drive action. It was thought that the development of the frictional engagement roller as a replacement for the long used pawl and gear arrangement was the solution, finally, but several problems were revealed which prevented these promises from ever being realized.

2. Description of the Prior Art

U.S. Pat. No. 2,469,572 to Pratt that issued on May 10, 1949 describes an early arrangement of a reversible friction clutch wrench to eliminate lost motion in gripping and releasing a rotary shaft.

U.S. Pat. No. 3,621,739 to Seablom that issued on Nov. 23, 1971 describes a plurality of rollers that are wedged between a rotatable cylindrical member and cam surfaces located in radial recess openings.

U.S. Pat. No. 3,823,625 to Myers that was granted on July 16, 1974 describes a ball in each of a plurality of arcuate recesses with a separator between each ball and a biasing spring.

U.S. Pat. No. 4,669,339 to Cartwright, granted on June 2, 1987, describes rollers fitted in semi-cylindrical bores to be wedged with cam faces for providing a reversible, instantaneously gripping friction drive action for a wrench.

At first appearance, the structural arrangements of these prior wrenches have similarities in form with the present improved reversible wrench, but they differ in material aspects. These differences will become more readily apparent as the description proceeds and are essential to the effective operation of the invention, as well as to the realization of the advantages of a structure according to the present invention, which advantages are not available with the prior wrenches.

OBJECTS AND SUMMARY OF THE INVENTION

It is an important object to provide a reversible ratchet wrench with a positive acting switch for changing the direction of rotation without risk of fouling.

It is also an important object of the invention to provide a structural arrangement for a reversible ratchet wrench whereby strength of the wrench is maximized in a smaller space.

A further object of the present invention is to provide a reversible wrench structural arrangement that admits of more positive locking action during use.

Yet a further object of the present invention is to provide a structural arrangement for a ratchet type tool drive with improved sealing from environmental contaminants.

Briefly, a ratchet type tool drive that is constructed and arranged in accordance with the principles of the present invention includes a handle of a desired length and shape with one end formed as a tool drive. The tool drive end has a cavity with smooth walls and a back surface with a smaller opening through which a tool engaging end of a spindle is fitted. The spindle fits against the back surface for sealing the cavity from environmental contaminants. A number of partitions extend from the wall of the cavity and terminate contiguous with the spindle, thereby defining a channel that narrows from its center toward the adjacent partition. A roller with a diameter to fit readily in the channel at its center but which will be pinched between the spindle and the channel wall a distance from the center less than the diameter of the roller. A retainer cover fits over the cavity to seal it and includes means to bias the roller in a desired direction.

DETAILED DESCRIPTION OF THE INVENTION

Figure 1:
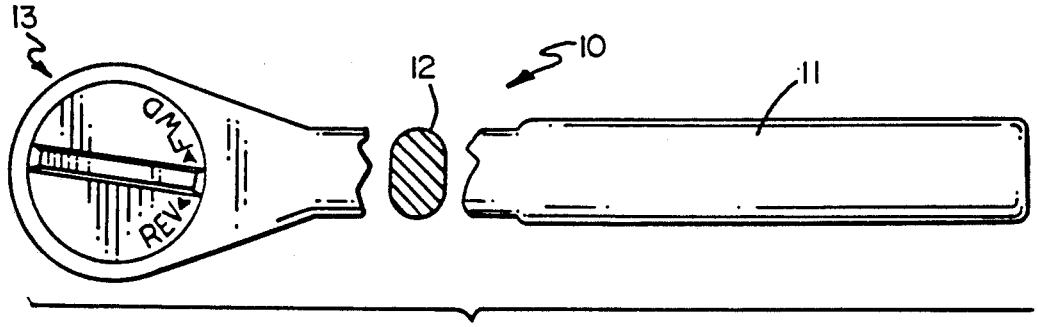
FIG. 1 is a fully assembled plan view of a reversible ratchet type tool drive in accordance with the invention.

Referring first to FIG. 1 of the drawings, a reversible ratchet wrench according to the present invention is identified generally by the reference numeral 10. Throughout the several figures in the drawings the same reference numerals will refer to the same or comparable parts.

The wrench 10 has a handle 11 with a cross section 12 that is thinner than it is wide, because more force will be applied during normal use in the direction of its width. Therefore, with a reduced thickness in the handle 11, the wrench 10 will be less weight and will present a more pleasing appearance to the eye of the purchasing public.

The length of the handle 11 will depend upon the leverage needed during use. The ends of the handle 11 may be any desired configuration, except that the end 13 is enlarged slightly to enclose the operating parts of the wrench 10, which will be described in more detail now.

Figure 2:
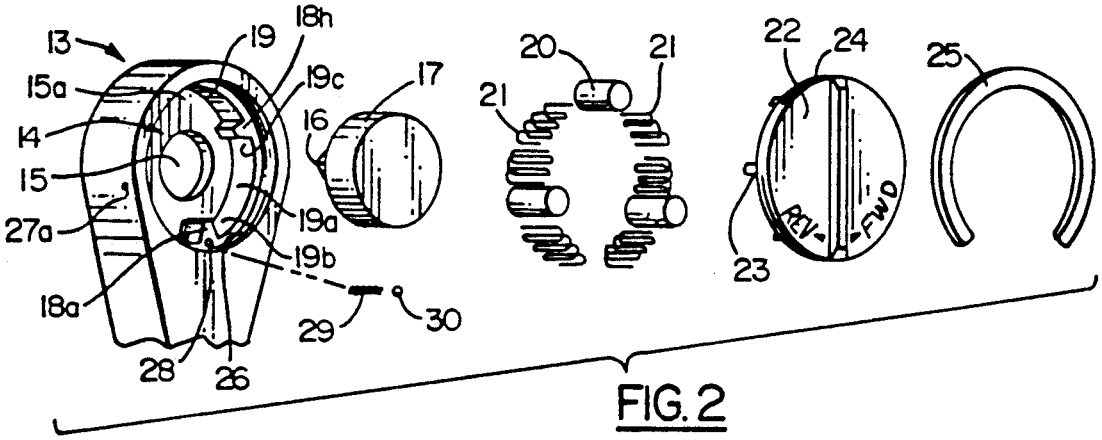
FIG. 2 is an exploded view showing the interrelationship of component parts of the present invention.

The exploded view of FIG. 2 shows the enlarged end 13 with a cavity 14 that is open a larger amount on one side, the side as viewed in this figure, than it is on the opposite side, where a smaller opening 15 is formed in a surface 15*a* to receive the socket engaging end 16 of a spindle 17. The fitting of the end 16 in the opening 15 will be described in more detail presently.

Also located within the cavity 14 are three partitions 18, two of which, the partitions 18*a* and 18*b*, are visible here. The partitions 18 have inner surfaces that fit closely with the spindle 17 to define three channels with the outer wall 19.

The outer wall 19 of the cavity 14, from which each of the partitions 18 protrude, are sloping a small amount. As measured from the side surface of the spindle 17, the outer wall 19 at a point 19*a* is farther from the spindle 17 than at either point 19*b* or at point 19*c*.

In other words, the outer wall 19 at points 19*b* and 19*c* is thicker than at 19*a*. With the spindle 17 in place within the cavity 14, it defines a channel, along with partitions 18 and the wall 19, that is narrower at the ends nearer each partition 18. This will be described in more detail hereinafter.

Located within each of these channels is a roller 20 with a coil spring 21 on each side. In a presently preferred form of the invention, each of the springs 21 has coils that approximate the dimensions of the channel into which they fit. An important advantage this permits is an antifouling action, in that the springs 21 will retain their shape, and therefore, their pressure against the roller 20 is distributed evenly along each roller 20. It has been found that this uniform pressure is transmitted much more uniformly to each roller 20, thereby increasing the effectiveness and more positive action of each roller 20, with no tendency to slip.

A retainer cover 22 is formed with extensions 23 to fit on each side of each partition 18, between the partition 18 and the end of each coil spring 21. The configuration in cross section of each extension 23 is any that may be desired, but the length of each extension 23 is sufficient so that it ends just before touching the inner surface 15*a* in which the opening 15 is formed.

The cover 22 has a groove 24 formed about its periphery to receive a split ring 25 partially, the balance of the width of the split ring 25 being received in a matching groove 26 just inside the cavity 14. The split ring 25 is removed by punching out small knockout openings 27*a* and 27*b* on either side of the end 13 and inserting a small wire or a suitable tool.

A small hole 28 is formed in the partition 18*a* to receive a coil spring 29 to urge a small detent ball 30 outwardly. The purpose of the detent ball 30 will be described in more detail hereinafter in connection with the operation of the wrench 10.

Figure 3:
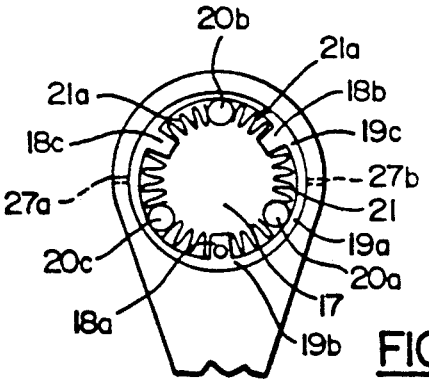
FIG. 3 is a plan view with cover removed showing operative parts of the invention.

FIG. 3 of the drawings shows the above described component parts in an operative interrelationship. The three partitions 18*a*, 18*b* and 18*c* are shown more clearly, and the spindle 17 is shown in place, defining the channels into which the three rollers 20*a*, 20*b* and 20*c* are fitted closely between matching springs 21 on either side.

A space, identified by the numeral 21*a*, is located on each side of each partition 18 to receive the extensions 23 between each partition 18 and the adjacent end of a spring 21. The purpose of this structure will be described in more detail in connection with the operation of the tool drive.

Figure 4:
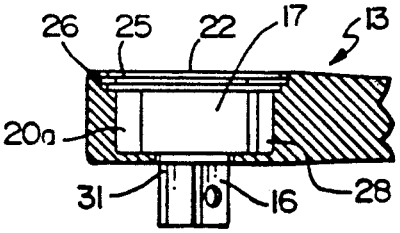
FIG. 4 is a side view partly in cross section showing other component parts of the invention in place.

FIG. 4 shows the end 13 with the respective component parts assembled, such as, with the spindle 17 in place with the socket engaging end 16 within the smaller opening 15, shown here filled completely with a round ridge 31 of nearly matching dimensions. The smaller opening 15 being substantially filled by the ridge 31 and the bottom of the spindle 17 fitted against the surface 15*a* at the bottom of the cavity 14, environmental contaminants are sealed out quite effectively. Also, the ridge 31 centers the spindle 17 closely between the contiguous ends of each of the partitions 18.

The cavity 14 is sealed effectively at the upper surface by the structure of the retainer cover 22 with the split ring 25 fitted within the grooves 24 and 26, illustrated best in this figure. Also shown here is the small hole 28 for receiving the coil spring 29, described hereinabove, and the roller 20*a*.

Figure 5A:
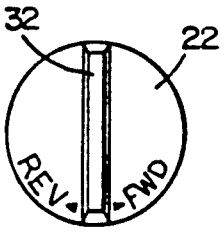
FIG. 5*a* is a top plan view of the assembly retainer cover for use as an aid in describing the invention.
Figure 5B:
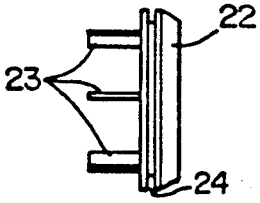
FIG. 5*b* is a full face side view of the assembly retainer cover as an aid in describing the invention.
Figure 5C:
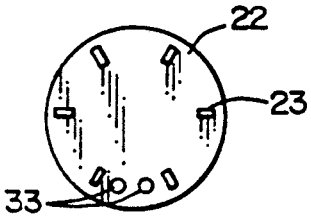
FIG. 5*c* is a view from the bottom of the assembly retainer cover as an aid in describing the invention.

In FIG. 5*a*, 5*b* and 5*c*, details of the retainer cover 22 are illustrated. A raised handle 32 extends from the top surface of the cover 22 for grasping between the thumb and forefinger of either hand to turn the cover in either a clockwise or a counterclockwise direction, for changing the acting direction of the wrench 10 from one of tightening or loosening, as needed. In the presently preferred form of the invention, a legend of "FWD" and "REV" is located, along with the arrows, as shown, on either side of one end of the handle 32.

There are six extensions 23 that extend from the under side of the cover 22, and they are located to fit between the end of a spring 21 and the adjacent surface of a partition 18, so that, as the cover 22 is turned in either the "FWD" or the "REV" direction, pressure is applied to the adjacent spring 21 that urges each roller 20 in a direction to become pinched between the narrowing walls of its channel.

Two small recesses 33 are located, as shown, on the under side of the cover 22 to receive the ball 30 which keeps the cover 22 in the position set by turning the handle 32. Also seen more clearly in this figure is the groove 24 for receiving the split ring 25, described supra.

Clearly, a structure in accordance with the hereinabove description is susceptible to any desired dimensions, it has been found that rollers of approximately 0.188 inch (4.763 mm) in diameter function effectively within a channel measuring approximately 0.195 inch (4.953 mm) at 19*a*. With the partitions 18 extending to define a channel width of approximately 0.165 inch (4.191 mm), the rollers 20 will rock into a tight pinching position after about one-half of a revolution.

In Operation

The operation of a ratchet type tool drive that is constructed and arranged in accordance with the present invention is unusually reliable, has very little backlash and will not slip regardless of the applied force. With the retainer cover 22 turned in a desired direction, the spring 21 urges the roller 20 in a direction that produces a firm contact between the spindle 17 and either narrowing channel wall 19*b* or 19*c*, so that a further turning of the wrench handle 11 develops a tight, pinching action that produces the unusual reliability.

By turning the wrench handle 11, then, in the opposite direction for another bite, the rollers 20 move in more of a rocking motion, permitting slippage between the rollers and the spindle 17. When the end of movement in that direction occurs and the direction of motion of the handle 11 is reversed, the rollers 20 roll back into a pinching position between the spindle 17 and the narrowing walls 19 in a rocking type motion that again causes the spindle 17 to be turned by the handle 11.

Movement of the rollers 20 from one operating position to another is by a slight rotating, or "rocking", motion, and therefore, there is little wear developed by the component parts. Since the number and the arrangement of the operating component parts are reduced substantially over prior structures, the profile appearance of the ratchet wrench 10 is thinner, without a sacrifice of its structural strength.

The invention has been shown, described and illustrated in substantial detail with reference to a presently preferred embodiment. However, it will be understood by those skilled in this art that changes and modifications may be made without departing from the spirit and scope of the invention which is defined by the appended claims.

What is claimed is:

1. A ratchet type tool drive, comprising:

handle means having a predetermined length and cross sectional configuration with one end formed to function as a tool drive;

means on said tool drive end of said handle means to define a cavity with substantially smooth inner walls and terminating in a surface with an opening;

spindle means bearing against said surface and with a tool engaging end fitted through said opening;

a predetermined number of partitions extending into said cavity from said inner walls and terminating contiguous with said spindle means to define channel means which narrows approximately 30 thousandths of an inch from the center in each direction toward an adjacent partition;

roller means within said channel means and having a diameter for fitting readily in said channel means at said center and being pinched between said spindle means and said narrowing channel means at a distance from said center approximately equal to said diameter of said roller means;

spring means located on each side of said roller means within said channel means; and retainer cover means fitted over said means to define a cavity and including means to engage said spring means for urging said roller means in a preselected direction;

so that said roller means is pinched in a positive locking action that resists any tendency to slip.

2. A ratchet type tool drive as defined by claim 1 wherein the number of said partitions extending into said cavity is three.

3. A ratchet type tool drive as defined by claim 1 wherein said means on said retainer cover means for engaging said spring means includes means projecting into said cavity for engaging an end of said spring means to urge said roller means in said preselected direction.

4. A ratchet type tool drive as defined by claim 1 wherein said narrowing of said channel means is in the order of 195 thousandths of one inch at its widest point to in the order of 165 thousandths of an inch at an adjacent one of said partitions, and the diameter of said roller means is approximately 188 thousandths of an inch.

5. A reversible ratchet type tool drive wrench, comprising:

handle means with an end having wall means that define a cavity with a larger opening to one side and with a smaller opening at an opposite side to receive a tool engaging end of a spindle means;

a predetermined number of partitions extending from said wall means toward said spindle means defining channels between said spindle means and each of said partitions;

said wall means being thinner at a point substantially midway between adjacent partitions and thicker by approximately 30 thousandths of one inch at a point adjacent a partition;

roller means within each of said channels and having a diameter to fit midway within said channels;

spring means located on each side of said roller means within each of said channels; and retainer cover means fitted over said open one side of said cavity and having means to engage said spring means to urge said roller means in a preselected direction;

so that said roller means is pinched in a positive locking action that resists any tendency to slip.

6. A reversible ratchet type tool drive wrench as defined by claim 5 wherein said retainer cover means includes means to select a direction of bias for said spring means, and means to maintain said direction of bias.

7. A reversible ratchet type tool drive wrench as defined by claim 5 wherein each of said spring means is formed to substantially fill each respective one of said channels on each side of said roller means.

8. A reversible ratchet type tool drive wrench as defined by claim 5 wherein said retainer cover means includes means to define a groove for receiving split ring means to cooperate with a matching groove in said means to define said cavity for maintaining said cover in place.

9. A reversible ratchet type tool drive wrench as defined by claim 5 wherein said number of partitions is three spaced symmetrically within said cavity.

10. A reversible ratchet type tool drive wrench as defined by claim 5 wherein said partitions are spaced symmetrically around said cavity to define a plurality of said channels, each of said channels being in the order of 195 thousandths of an inch at its widest point to receive said roller means with a diameter of approximately 188 thousandths of one inch.

* * * * *